US006883907B2

(12) United States Patent
Martinez

(10) Patent No.: US 6,883,907 B2
(45) Date of Patent: Apr. 26, 2005

(54) INK CARTRIDGE AND EXPANSIBLE BLADDER FOR AN INK CARTRIDGE

(75) Inventor: Adrian J Martinez, Villa Caroline Carolina, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/279,644

(22) Filed: Oct. 24, 2002

(65) Prior Publication Data

US 2004/0080589 A1 Apr. 29, 2004

(51) Int. Cl.[7] ..... B41J 2/175
(52) U.S. Cl. ..... 347/87
(58) Field of Search ..... 347/85, 86, 87; 222/386.5

(56) References Cited

U.S. PATENT DOCUMENTS 5,040,001 A 8/1991 Dunn et al.
5,440,333 A 8/1995 Sykora et al.
5,515,092 A 5/1996 Swanson et al.
5,537,134 A * 7/1996 Baldwin et al. ..... 347/85
5,541,632 A 7/1996 Khodapanah et al.
5,686,948 A 11/1997 Crystal et al.
5,988,803 A 11/1999 Komplin et al.
6,053,607 A 4/2000 Kaplinsky et al.
6,196,669 B1 3/2001 Harvey et al.
6,206,515 B1 3/2001 Swanson et al.
6,247,806 B1 6/2001 Matsumoto et al.
6,367,666 B1 * 4/2002 Hou et al. ..... 222/386.5
6,382,784 B1 * 5/2002 Pawlowski et al. ..... 347/85

FOREIGN PATENT DOCUMENTS

EP 0437363 7/1991
JP 60-240456 * 11/1985

* cited by examiner

*Primary Examiner*—Anh T. N. Vo

(57) ABSTRACT

In one embodiment an ink cartridge includes a housing defining a first fluid reservoir, and an expansible bladder defining a second fluid reservoir. The bladder is located within the first fluid reservoir, and includes opposing first and second wall members. The first wall member is fabricated from a material having a first shape-memory, and the second wall member is fabricated from a material having a second shape memory which is less than the first shape memory. In another embodiment a method of producing an expansible bladder includes providing a synthetic sheet fabricated from a material having a shape-memory, and folding the sheet in a generally "U" shape to produce first and second opposing wall members. Each wall member has two side edges and a top edge. The first and second wall members are sealed to each other along the side edges and top edges.

24 Claims, 6 Drawing Sheets

INK CARTRIDGE AND EXPANSIBLE BLADDER FOR AN INK CARTRIDGE

FIELD OF THE INVENTION

The invention claimed and disclosed herein pertains to liquid ink cartridges for use in liquid ink imaging apparatus, and more particularly to ink cartridges having an expansible bladder.

BACKGROUND

Imaging apparatus are primarily provided in two different configurations—liquid ink imaging apparatus and dry toner imaging apparatus. As used herein, "imaging apparatus" includes any type of apparatus which is configured to generate an image on a sheet of imaging media (such as paper or the like), and includes printers, photocopies, facsimile machines, and combinations thereof (i.e., so-called "multi-function printers"). Liquid ink imaging apparatus are commonly known as "ink-jet imaging apparatus" because tiny droplets of liquid ink are projected from a print head onto a sheet of imaging media to form an image. Liquid ink is provided to ink-jet imaging apparatus by an ink delivery system, which is typically either a single-use replaceable cartridge or a tank resident within the imaging apparatus and which is refilled periodically from a larger reservoir.

Regardless of which type of ink delivery system is used, one of the main goals is to reduce (and preferably eliminate) extraneous ink from dripping or "drooling" out of the print head. Two primary designs are used to achieve this objective. The first design is to use a capillary foam to entrain the liquid ink, wherein the capillary action of the foam is sufficient to overcome gravitational forces which would otherwise tend to cause the ink to drip or drool from the pint head. The second design is to use a negative pressure system to impart a slight negative pressure (i.e., a pressure slightly lower than ambient atmospheric pressure) on the liquid ink, thereby biasing ink flow into the reservoir until acted on by the print head, thus forcing the ink out of the reservoir. Another primary objective in ink delivery systems is to reduce (and preferably, eliminate) any entrained air from entering the liquid ink, which can adversely affect performance of the imaging apparatus and the resultant image quality. One of the more common types of negative pressure system utilizes an expansible bag or bladder which is placed within the ink reservoir. Such a system is depicted in FIG. 1 (described below). These prior art bladders typically include a separate metal spring, generally in the shape of a shaped plate, which facilitates in biasing wall members of the bladder either towards or away from one another.

The prior art designs are generally effective in reducing or eliminating ink drool from the print head of an ink cartridge. However, the metal spring members which are used to bias the bladder walls to predetermined positions relative to one another can sometimes puncture the bladder during assembly, rendering the cartridge useless. Further, a separate spring member adds to the complexity of the design and the construction of the bladder system.

What is needed then is a liquid ink containment and delivery system for use in liquid ink imaging apparatus which achieves the benefits to be derived from similar prior art devices, but which avoids the shortcomings and detriments individually associated therewith.

SUMMARY

In one embodiment an ink cartridge includes a housing defining a first fluid reservoir, and an expansible bladder which defines a second fluid reservoir. The expansible bladder is located within the first fluid reservoir, and includes opposing first and second wall members. The first wall member is fabricated from a material having a shape-memory to thereby bias the first wall member to a first position relative to the second wall member.

In another embodiment a method of producing an expansible bladder for use in a liquid ink cartridge includes providing a synthetic sheet fabricated from a material having a shape-memory, and folding the sheet in a generally "U" shape to produce first and second opposing wall members. Each wall member has two side edges and a top edge. The first wall member is sealed to the second wall member along the side edges and top edges to thereby produce the expansible bladder.

These and other aspects and embodiments will now be described in detail with reference to the accompanying drawings, wherein:

DETAILED DESCRIPTION

As described above, certain prior art ink cartridges for use in imaging apparatus include a bladder (either an expansible bladder or a collapsible bladder) which facilitates in governing the flow of ink to a print head used to apply the liquid ink to a sheet of imaging media. The prior art bladders can be used either to contain the liquid ink itself, or to contain air which displaces the liquid ink as the ink is consumed from the cartridge. Further, these prior art bladders typically include a separate metal spring, generally in the shape of a shaped plate, which facilitates in biasing wall members of the bladder either towards or away from one another. As also described above, there are certain disadvantages in using these metal springs. The present invention provides for a bladder for use in a liquid ink cartridge which includes a wall member having shape-memory characteristics, to thereby allow the prior art metal spring to be eliminated. As used herein, "expansible bladder" shall include bladders that are intended to expand during their intended use, as well as bladders which are intended to collapse during their intended use. That is, "expansible bladder" means a variable-volume vessel for containing a fluid (such as liquid ink or air) having a flexible first wall member and a second wall member. The first and second wall members can be moved relative to one another to thereby vary the capacity of the vessel.

Figure 1:
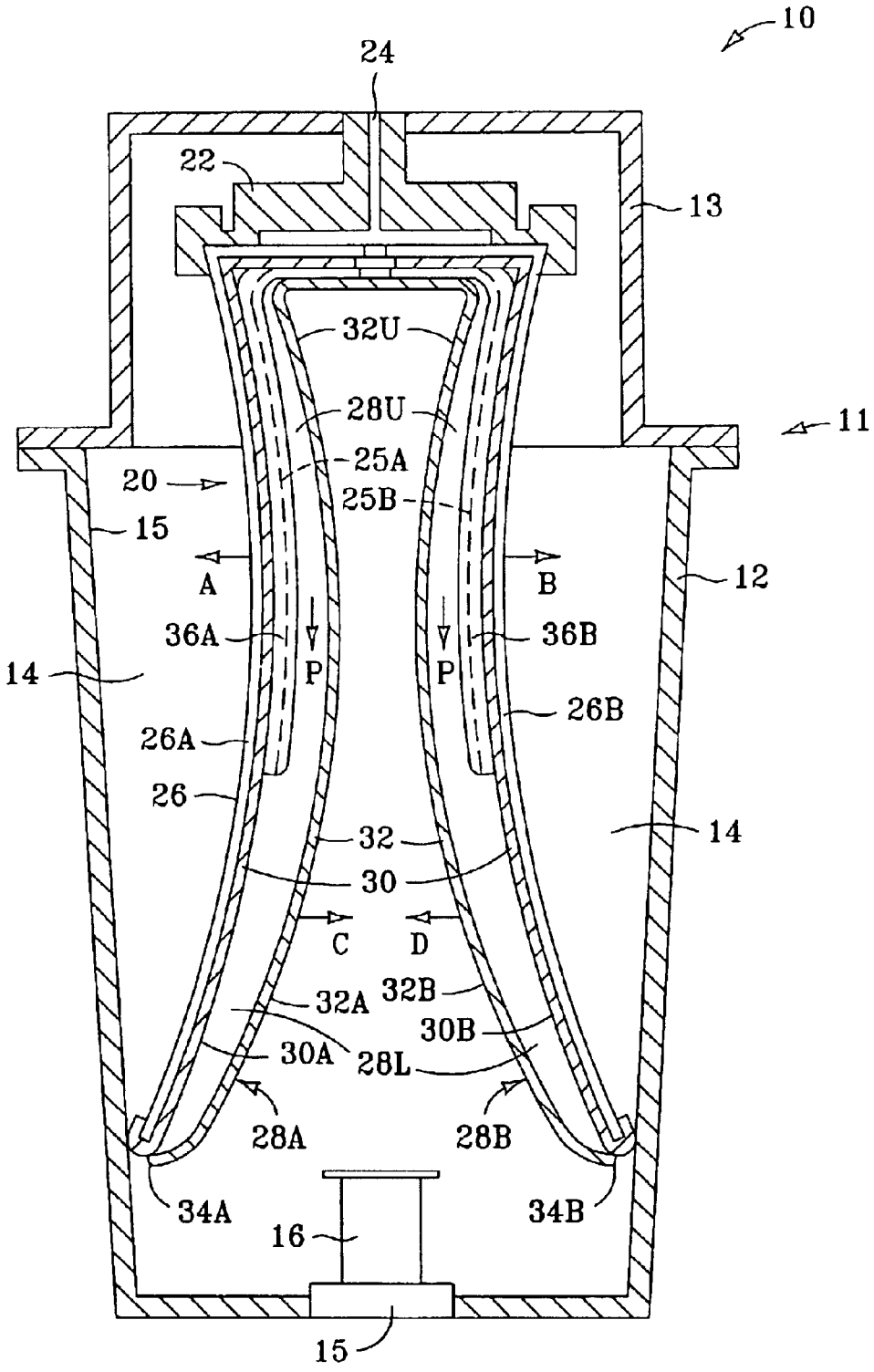
FIG. 1 (Prior Art)
FIG. 1 is a side sectional view depicting a prior art liquid ink cartridge.

FIG. 1 is a side sectional view of a prior art ink cartridge 10 which includes a housing 11 that has a top portion 13 and a bottom portion 12. The top portion 13 is typically joined to be bottom portion 12 during assembly by gluing or fusing the portions together. The housing bottom portion 12 defines an ink reservoir 14, and supports a print head 15. A standpipe 16 admits ink from the ink reservoir 14 into the print head. The standpipe 16 can be fabricated in-part from a fine mesh which resists the flow of air from the print head 15 into the ink reservoir 14. The ink cartridge 10 further includes an expansible bladder-type negative pressure system 20 which is supported by a fitment 22, which is in turn supported by the housing upper portion 13. Thus, during assembly of the ink cartridge 10 the negative pressure system 20 is placed within the ink reservoir 14 in the housing lower portion 12 as the upper portion 13 and housing lower portion 12 are joined together.

The negative pressure system 20 depicted inn FIG. 1 includes two expansible bladders 28A and 28B. Each expansible bladder 28A, 28B is made from a flexible, impermeable film, such as a polyethylene film, so that the bladders can contain air. More specifically, in fabricating the bladders 28A and 28B a first polyethylene film 30 is laid on top of a second polyethylene film 32, and the films are then sealed to one another along their open peripheral edges. The attached films 30, 32 are then generally folded in half, producing first expansible bladder 28A having sidewalls 30A and 30B, and second expansible bladder 28B having sidewalls 30B and 32B. The folded bladder assembly 20 is secured to the fitment 22. An airway opening 24 in the fitment 22 allows ambient air to move into the expansible bladders 28A, 28B. During fabrication of the bladders 28A, 28B a metal spring 26 is also secured to the outer film layer 30. This can be accomplished by using heat and/or adhesives. Consequently, when the film/spring assembly is "folded" into the shape depicted in FIG. 1, the spring 26 produces a first spring member 26A associated with bladder 28A, and a second spring member 26B associated with bladder 28B. The spring 26 biases the outer film layer 30 in directions "A" and "B" so that the ends 34A and 34B of respective bladders 28A and 28B are pressed against the inner wall of the housing lower portion 12. However, the inner film layer 32 is free to move inward in directions "C" and "D". When the bladders 28A, 28B are initially installed in the housing 11, the inner film layer 32 is in contact with the outer film layer 30. As ink is consumed from the ink reservoir 14, the pressure within the ink reservoir drops, causing inner film layers 32A and 32B to move in respective directions "C" and "D". In order to facilitate separation of the two film layers 30, 32 as the pressure within the ink reservoir 14 drops, an airway can be inserted into each bladder (airway 36A in bladder 28A, and airway 36B in bladder 28B). The airways 36A and 36B are in fluid communication with the airway opening 24, allowing ambient air to flow into the bladders 28A, 28B. More specifically, airways 36A and 36B have respective longitudinal channels 25A and 25B (indicated by hidden lines) formed therein. When the bladders 28A, 28B are in the initial, collapsed position and the upper portions 32U of the inner film layer 32 are in contact with the airways 36A and 36B, the channels 25A and 25B allow air to move in direction "Q" into the lower part 28L of the bladders 28A, 28B. When the airways 36A, 36B are not provided, it is possible for the lower part 28L of the bladders 28A, 28B to be cut-off from the upper part 28U of the bladders. The airways 36A, 36B prevent this by providing a channel 25A, 25B for air to move from the upper part 28U of the bladders 28A, 28B into the lower part 28L of the bladders.

In operation, as ink is removed from the ink reservoir 14 of the liquid ink cartridge 100, the expansible bladders 28A, 28B expand to fill the void created by the removed ink, so that the pressure of the remaining ink in the reservoir 14 does not become so low that ink will not flow out of the print head 15. More specifically, the bladder outer walls 30A and 30B will be biased in respective directions "A" and "B", but the bladder inner walls 32A, 32B will be free to move in respective directions "C" and "D", thus allowing bladders 28A and 28B to expand or inflate.

Figure 2:
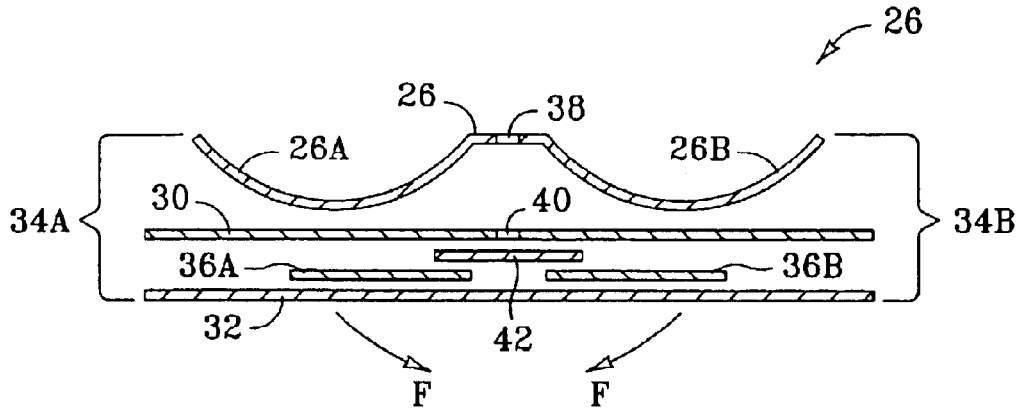
FIG. 2 (Prior Art)
FIG. 2 is an exploded side view depicting selected prior art components that can be used in the ink cartridge of FIG. 1.

Turning to FIG. 2, a side sectional view of selected components which make up the expansible bladders 28A, 28B of FIG. 1 are depicted. Included are the inner film layer 32, the air passageways 36A and 36B, a release diaphragm 42, the outer film layer 30, and the spring member 26, which has arms 26A and 26B. The components are assembled in a stack, and secured (as by heat or gluing) at the ends 34A and 34B of the bladder components and along the edges of the film layers 30, 32. The assembled stack of components is then "folded" in directions "F" to produce the ink pressure control system 20 depicted in FIG. 1, except that in FIG. 1 the arms 26A, 26B of the spring 26 are compressed from their "at rest" position (i.e., arms 26A and 26B are pushed towards one another in directions "C" and "D" in FIG. 1). As can be seen, an air hole 38 is formed in the spring 26, and another air hole 40 is formed in the outer film layer 30. When the assembled bladder components are secured into the fitment 22 (FIG. 1), the air holes 38 and 40 (FIG. 2) align with the airway opening 24 (FIG. 1) to allow air to flow into the area between the film layers 30 and 32. A release dot 42, which is a silicon-coated or impregnated patch, is placed between the film outer layer 30 and the film inner layer 32 in the area where the outer layer 30 will be heat-attached to the fitment (22, FIG. 1) to keep the two film layers 30, 32 from sticking to one another during the heat attachment process.

It will be appreciated that the thicknesses of the bladder components depicted in FIGS. 1 and 2 (e.g., inner and outer film layers 30 and 32, spring 26, and airways 36A and 36B) are exaggerated in the drawings to facilitate visualization of the components. In reality these components are typically very thin. For example the film layers 30 and 32 are typically polyethylene film having a thickness of 1.2 mils, while the metal spring member 26 can be only 5 to 10 mils in thickness.

In another arrangement, rather than ink being placed directly in a reservoir defined by the ink cartridge housing (such as reservoir 14 of FIG. 1), and the expansible bladder being exposed to air at atmospheric pressure, the function of the two components can be reversed such that ink is placed in the expansible bladder, and the interior of the ink cartridge is exposed to atmospheric pressure. In this case, a convex metal spring system is placed in the expansible bladder so that the spring exerts a slight outward force on the bladder to thus maintain a small negative pressure on the ink in the bladder as ink is removed. (See for example U.S. Pat. No. 6,206,515.) In this case the bladder might more properly be defined as a "collapsible bladder", since it tends to collapse during use. However, generically the expansible air bag bladders 28A, 28B of FIG. 1, and the collapsible ink bladder of the system just described, are all "bladders", and the terms "expansible" and "collapsible" merely describe the action of the bladder during its intended use. In fact, the term "expansible bladder" is appropriate for both systems, since the air bladders 28A, 28B of FIG. 1 expand during their intended use, and an ink bladder is expanded from an unfilled position to a filled position prior to being placed into service in an ink cartridge.

Figure 3:
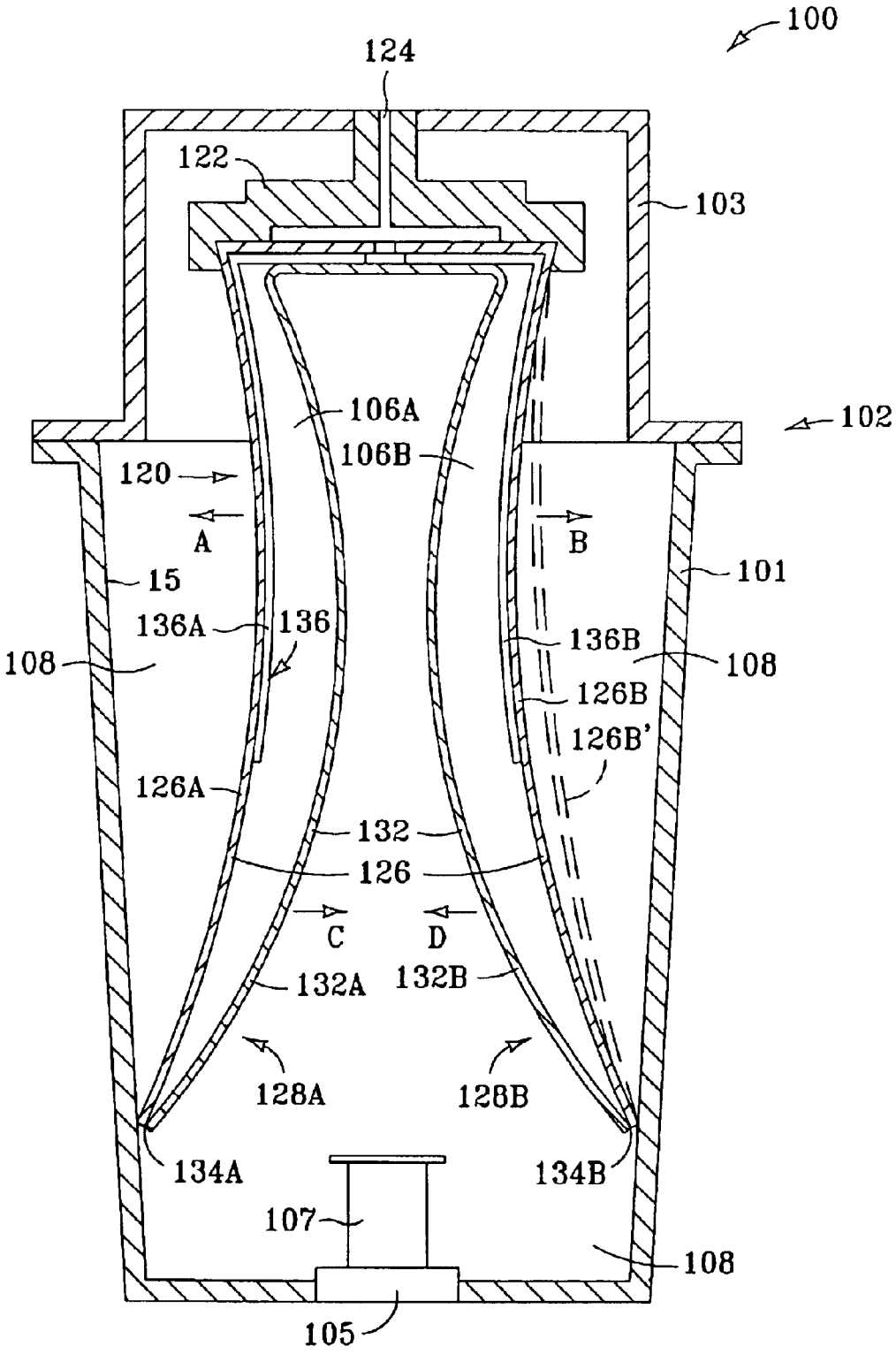
FIG. 3 is a side sectional view depicting a liquid ink cartridge in accordance with a first embodiment.

Turning now to FIG. 3, a side sectional view depicts a first embodiment of an ink cartridge 100. The ink cartridge 100 includes a housing 102 having a top portion 103 attached to a bottom portion 101. The housing 102 defines a first fluid reservoir 108, which in this instance is intended to contain liquid ink. The ink cartridge 100 further includes a print head 105, and a standpipe 107 which admits liquid ink from the ink reservoir 108 to the print head 105. The ink cartridge 100 is provided with an air/pressure control system 120, which includes a first expansible bladder 128A and a second expansible bladder 128B. It will be appreciated that two expansible bladders are not necessary for operation of the ink cartridge 100, and that only a single expansible bladder can be used, as will be more fully described with respect to FIG. 6 below. The air/pressure control system 120 of FIG. 3 is supported within the first fluid reservoir 108 by a fitment 122, which is in turn supported by the upper portion 103 of the housing 102. Each expansible bladder 128A, 128B defines a respective second fluid reservoir 106A, 106B, which in this instance is intended to contain ambient air. An air inlet opening 124 in the fitment 122 allows ambient air to enter the bladders 128A, 128B to thereby vent the second fluid reservoirs 106A, 106B to the atmosphere.

Bladder 128A is formed from opposing first and second wall members, being outer wall member 126A and inner wall member 132A, which are joined together (such as by heat/and or gluing) at end 134A, as well as along the sides of the wall members 126A, 132A. Although in FIG. 3 the sides of wall members 126A and 132A are depicted as being spaced apart, this is due to the fact that the sectional view of FIG. 3 is taken through the middle of the bladders 128A, 128B, and that the wall members 126A and 132A are brought together at their edges. The first wall member 126A is fabricated from a material having a first shape-memory to thereby bias the first wall member 126A to a first position (in FIG. 3, to a position in direction "A") relative to the second wall member 132A. Similarly, bladder 128B is formed from opposing third and fourth wall members, being outer wall member 126B and inner wall member 132B. The wall members 126B and 132B are joined at end 134B, as well as along their sides in the manner described above with respect to wall members 126A and 132A of bladder 128A. The third wall member 126B of bladder 128B is fabricated from a material having the first shape-memory to thereby bias the first wall member 126B to a first position (in FIG. 3, to a position in direction "B") relative to the fourth wall member 132B. The term "shape-memory" means a member that is elastically deformable from a first at-rest position to a second stressed position, and when in the second position is biased to return to the first position. In this manner an expansible bladder wall member fabricated from a material having a shape-memory can perform the intended function of prior-art metallic spring members used in such prior art bladders. In the example depicted in FIG. 3, the second and fourth wall members 132A and 132B are preferably fabricated from a material having a second shape memory which is less than the first shape memory of first and third wall members 136A and 136B. More preferably, the second and fourth wall members 132A and 132B have essentially no shape memory, and are fabricated from a relative thin material (as compared to the thickness of the material from which the first and third wall members 126A and 126B are fabricated). For example, the first and third wall members 126A, 126B can be fabricated from a polyethylene extrusion having a thickness of between about 5 to 15 mils, and the second and fourth wall members 132A and 132B can be fabricated from a polyethylene sheet having a thickness of between about 1 and 2 mils.

As can be seen in FIG. 3, the first and third wall members 126A, 126B can be fabricated from a single piece, such as first wall member element 126. For example, first wall member element 126 can be an extruded polyethylene member. The properties of the selected material used to fabricate the first wall member element 126, the extrusion process used to fabricate the element 126, and any post-extrusion finishing can be applied to provide the first wall members 126A, 126B with desired shape-memory characteristics. For example, based on the characteristics of the standpipe, it will be known at what pressure range ink within the first reservoir 108 should be maintained at to prevent drooling of ink from the print head 105. Shape-memory characteristics (in the way of spring constants, for example) can then be selected for first wall member element 126 to maintain the first and third wall members 126A, 126B in a preferred position during operation of the ink cartridge 100. As can also be seen in FIG. 3, the second and fourth wall members 132A and 132B can be fabricated from a single second wall member element 132. In the embodiment depicted in FIG. 3, the first and third wall members 126A and 126B can be fabricated from a relatively stiff material (i.e., relative to the stiffness of the second wall members 132A and 132B). For example, first wall member element 126 can be an extruded polyethylene member, and the second wall member element 132 can be a sheet of polyethylene film. It will be appreciated that the thicknesses of the bladder components depicted in FIG. 3 (e.g., first wall member element 126 and second wall member element 132) are exaggerated in the drawing to facilitate visualization of the components. In reality these components are typically relatively thin as compared to the height and width of the components 126 and 132.

In operation, as ink is consumed from the ink reservoir 108, the fluid reservoirs 106A and 106B will begin to fill with air, and the second and fourth wall members 132A and 132B will expand in respective directions "C" and "D" while the first and third wall members 126A and 126B will remain essentially fixed. At a certain point the ink level in the ink reservoir 108 can become low enough that the first and third wall members 126A and 126B begin to deflect in respective directions "A" and "B", as indicated by the dashed line 126B'. However, because the wall member 126B is fabricated from a material having shape memory, there will be a bias on the wall member 126B in direction "D", thus creating a lower pressure in the ink reservoir 108 than in the air reservoir 106B.

Figure 4:
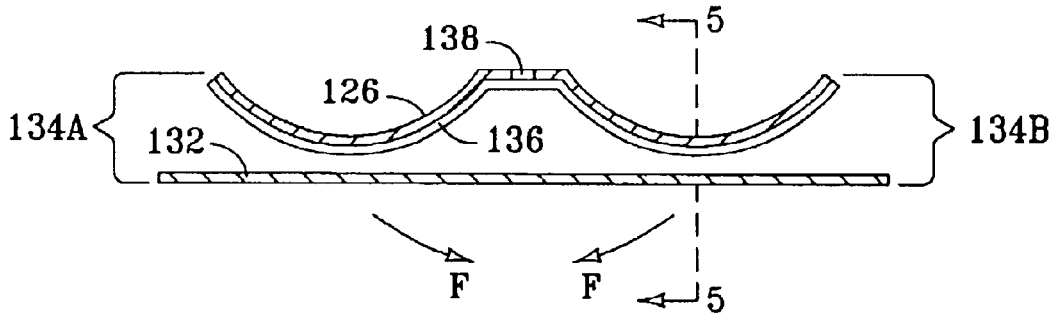
FIG. 4 is an exploded side view depicting selected components that can be used in the ink cartridge of FIG. 3.
Figure 5:
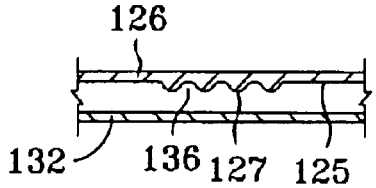
FIG. 5 is an exploded end sectional view depicting the ink cartridge components of FIG. 4.

FIG. 4 is an exploded side view depicting selected components that can be used to assemble the air/pressure control system 120 in the ink cartridge 100 of FIG. 3. Specifically, a synthetic sheet 126 having a shape-memory is provided, which can be used alone, or in conjunction with another sheet, to form the bladder(s) 128A/128B by folding the synthetic sheet 126 in directions "F". In FIG. 4 the synthetic sheet 126 is depicted as having two bowed sections separated by a central section. Each bowed section corresponds to first and third wall members 126A and 126B of FIG. 3. The bowed sections allow secondary biasing forces (described above with respect to deformed first wall member 126B' of FIG. 3) to be applied by the bladder 128B to thereby reduce the pressure in the in the ink reservoir 108. However, it will also be appreciated that first wall member element 126 (FIG. 4) can also be flat, or have other shapes. In the example depicted in FIG. 4, a second synthetic sheet 132 is also provided. The first synthetic sheet 126 can be, for example, a polyethylene extrusion defined by a first periphery and having a thickness of between about 5 and 15 mils. The second synthetic sheet 132 can be, for example, a sheet of polyethylene film defined by a second periphery and having a thickness of between about 1 to 3 mils. The sheets 126 and 132 can be laid on top of one another and then generally joined along their peripheries (ends 134A and 134B, and sides disposed between the ends) by heat or gluing or the like. The attached sheets 126 and 132 can then be folded in directions "F" to produce first and third wall members (e.g., wall members 126A and 126B of FIG. 3) as well as second and fourth wall members (e.g., wall members 132A and 132B of FIG. 3). An air inlet hole 138 can be provided in the first synthetic sheet 126 such that when bladders 128A and 128B (FIG. 3) are formed from the sheets 126 and 132, the air hole 138 can be placed in fluid communication with air opening 124 in the fitment 122 (FIG. 3), thus allowing air to enter the second reservoirs 106A and 106B. In order to facilitate movement of fluid (e.g., air) into the bladders 128A and 128B of FIG. 3, an air channel segment which functions as an air passageway can be provided. One such example is depicted in FIG. 5, which is an end sectional view of the assembly of components of FIG. 4. As seen in FIG. 5, the first synthetic sheet 126 (which defines the first and third wall members 126A, 126B of FIG. 3) defines an inner or primary surface 125 which faces the synthetic sheet 132 (synthetic sheet 132 defining the second wall members 132A, 132B, FIG. 3). The first synthetic sheet 126, which can be an extruded polyethylene member, includes an air channel segment 136 formed thereon, and which protrudes above the inner surface 125. The air channel segment 136 is characterized by an irregular outward facing surface 127 so that when the second synthetic sheet 132 comes into contact with the air channel segment 136, airways are provided between the sheets 126 and 132 by the channels defined by the irregular outward facing surface 127. It will be appreciated that a similar airway arrangement can be provided even when a second synthetic sheet 132 is not used to form the bladder.

Figure 6:
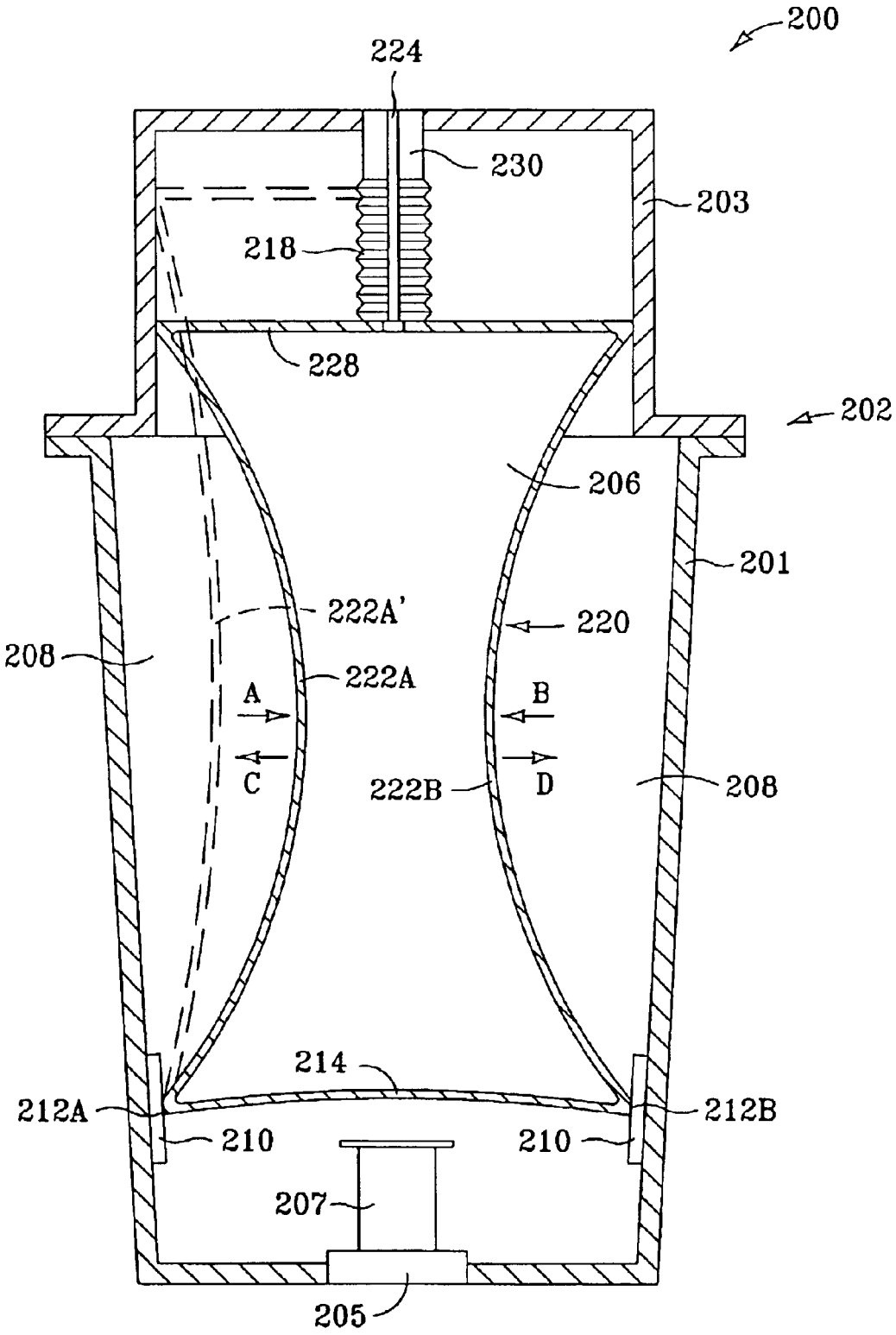
FIG. 6 is a side sectional view depicting a liquid ink cartridge in accordance with a second embodiment.

FIG. 6 is a side sectional view depicting a liquid ink cartridge 200 in accordance with a second embodiment. The ink cartridge 200 includes a housing 202 having a top housing portion 203 attached to a bottom housing portion 201. The housing 202 defines a first fluid reservoir 208, which in this instance is intended to contain liquid ink. The ink cartridge 200 further includes a print head 205 and a standpipe 207, which admits liquid ink to the print head 205. The ink cartridge 200 is provided with an expansible bladder 220 for air/ink control. Unlike the air/ink control system 120 of FIG. 3, the air/ink control system 220 of FIG. 6 includes only a single bladder 220 having a first wall member 222A, and a second wall member 222B, both of which are preferably fabricated from a material having a shape-memory. In this way the first wall member 222A is biased in direction "A" relative to the second wall member 222B, and the second wall member 222B is biased in direction "B" relative to the first wall member 222A. The bladder 220 is supported in the housing 202 by a fitment 230. Fitment 230 defines an air inlet opening 224 to allow ambient air to flow into the reservoir 306 which is defined by the bladder 220. Thus, as ink is removed from the ink reservoir 208, wall members 222A and 222B will move in respective directions "C" and "D" (as indicated by shifted wall member 222A', which is indicated by dashed lines), and air will move into the reservoir 206. However, because of the memory-shape nature of the material from which wall members 222A and 222B are fabricated, they will be biased in respective directions "A" and "B", thus producing a slight negative pressure on the remaining ink in the reservoir 208 (i.e., a slight negative pressure relative to the ambient pressure outside of the cartridge housing 102). It will be appreciated that the thickness of the bladder components depicted in FIG. 6 (e.g., wall members 222A and 222B) are exaggerated in the drawing to facilitate visualization of the components. In reality these components are typically relatively thin as compared to the height and width of the components.

It will be also appreciated that the bladder 220 is depicted in a sectional view in FIG. 6, and thus the wall members 222A and 222B are shown in spaced-apart relationship. However, wall members 222A and 222B are preferably brought together at their edges and sealed together there along to produce a pouch or bladder defining the second fluid reservoir (air chamber) 206. The wall members 222A and 222B can be joined at their respective bottom edges 212A and 212B by a bottom member 314. Likewise, the wall members 222A and 222B can be jointed at their top edges by a top member 228. In order to allow the free flow of liquid ink around the corners 212A and 212B, the housing 202 can be provided with fluid passageways 210. It will be further appreciated that some elongation of the bladder 220 can occur as a result of straightening the concave wall members 222A and 222B. (See for example wall member 222A', which has been moved in direction "C" from its at-rest position indicated by 222A.) To accommodate this elongation the top member 228 of the bladder 220 can be connected to the fitment 230 by a flexible connector, such as the bellowed connecter 218 depicted in FIG. 6. It will also be appreciated that the wall members 222A and 222B do not need to be arranged in a concave configuration as depicted in FIG. 6. However, the concave configuration of the wall members 222A and 222B allows for greater liquid ink storage capacity (i.e., a larger ink reservoir 208) in the ink cartridge 200.

Figure 7:
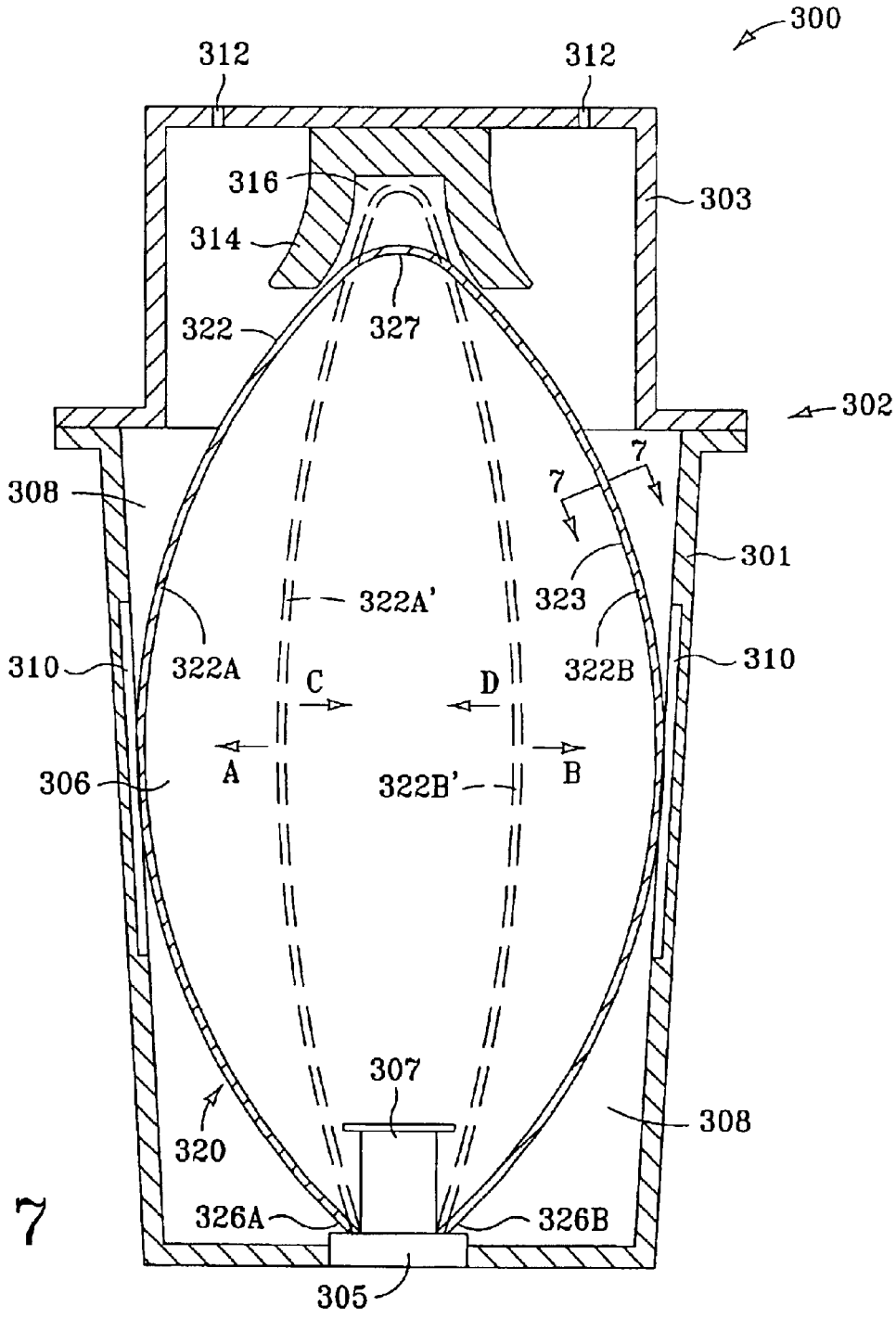
FIG. 7 is a side sectional view depicting a liquid ink cartridge in accordance with a third embodiment.

Thus far embodiments have been described wherein liquid ink is intended to be placed in the reservoir defined by the cartridge housing (e.g., first reservoirs 108 and 208 of respective FIGS. 3 and 6), while the second reservoir (i.e., the reservoir defined by the expansible bladder) is intended to contain air. A third embodiment will now be described wherein liquid ink is intended to be contained in the expansible bladder while the interior area between the bladder and the ink cartridge housing is intended to fill with air as ink is consumed from the bladder. FIG. 7 is a side sectional view depicting a liquid ink cartridge 300 in accordance with the third embodiment. The ink cartridge 300 includes a housing 302 having a top portion 303 attached to a bottom portion 301. The housing 302 defines a first fluid reservoir 308, which in this instance is intended to fill with air. Air inlet openings 312 in the housing upper portion 303 allow ambient air to enter the air chamber 308. The ink cartridge 300 further includes a print head 305 and a standpipe 307, which admits liquid ink to the print head 305. The ink cartridge 300 is provided with an expansible bladder 320, which functions as an ink containment system. The bladder 320 includes first wall member 322A and second wall member 322B. One or both of wall members 322A and/or 322B are fabricated from a shape-memory material. Wall members 322A and 322B together define a second fluid reservoir 306 which is intended to be filled with liquid ink. The bladder 320 can be fabricated from a single piece, such as a single synthetic sheet similar to wall member element 126 of FIG. 4. For example the wall members 322A and 322B of FIG. 7 can be segments of a single, flat polyethylene sheet or extrusion 322 which is folded in a generally upside-down "U" shape at the fold area 327 to place the ends of the sheet (326A and 326B) in proximity to one another. The folding of the sheet 322 bows the sheet into the convex shaped wall segments 322A and 322B, giving them a spring-like bias in respective directions "A" and "B" (that is, wall members 322A and 322B are biased in a first position relative to one another). The ends (end edges) 326A and 326B of the sheet 322 can be sealed to one another, and the end edges can also sealed around the standpipe 307 to allow liquid ink to flow from the ink reservoir 306 to the print head 305 via the standpipe 307. It will be appreciated that the bladder 320 is depicted in a sectional view, and thus the wall members 322A and 322B are shown in spaced-apart relationship. However, wall members 322A and 322B are brought together at their outer edges (between fold point 327 and ends 326A and 326B) and sealed together there along to produce a pouch or bladder defining the second fluid reservoir (ink chamber) 306, as will be described more fully below with respect to FIG. 9. It will be appreciated that the thickness of the bladder components depicted in FIG. 7 (e.g., wall members 322A and 322B) are exaggerated in the drawing to facilitate visualization of the components. In reality these components are typically relatively thin as compared to the height and width of the components.

In operation, as liquid ink is consumed from the ink reservoir 306 defined by the bladder 320, a partial vacuum occurs (i.e., pressure in the ink chamber 306 becomes lower than the pressure in the air chamber 308), and consequently the wall members 322A and 322B begin to collapse in respective directions "C" and "D". As the wall members 322A and 322B move inwards, the volume of the air chamber 308 is increased, and thus ambient air moves through the air inlet openings 312 to fill the expanding air chamber 308. As the bladder 320 collapses in directions "C" and "D", the wall members 322A and 322B will still be biased in respective directions "A" and "B", thus creating a pressure differential between the ink reservoir 306 and the air chamber 308. Specifically, the pressure in the ink reservoir 306 will be lower than the ambient pressure in the air chamber 308, and thus liquid ink will not tend to freely drool from the print head 305. As can be seen, in this instance the bladder 320 might be described as a "collapsible bladder" due to the fact that it collapses during its intended use. However, the fact that the bladder 320 can also expand once the vacuum within the bladder is relieved shows that it is also an expansible bladder, and therefore it is proper to use the expression "expansible bladder" for the bladder 320 of FIG. 7.

Figure 8:
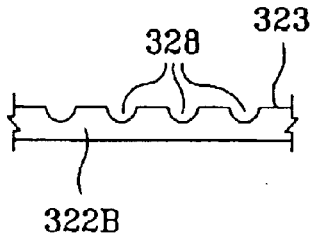
FIG. 8 is an end sectional view depicting a wall of a bladder used in the ink cartridge of FIG. 7.

It will be appreciated that some elongation of the bladder 320 can occur as a result of straightening of the convex wall members 322A and 322B (to respective positions 322A' and 322B') as liquid ink is consumed from the ink reservoir 306. To accommodate this elongation the top end of the bladder 320 near the fold point 327 can be fitted into a guide 314 having an expansion area 316. It will also be appreciated that the wall members 322A and 322B do not need to be initially arranged in a convex configuration (i.e., when the bladder 320 is initially filled with ink) as depicted in FIG. 7. However, the convex configuration of the wall elements 322A and 322B allows for greater liquid ink storage capacity (i.e., a larger ink reservoir 306) in the ink cartridge 300. Air channels 310 can be formed in the housing lower portion 301 to allow air to move into the lower areas of the air chamber 308 until such time as the bladder wall members 322A and/or 322B have moved inwards (i.e., in respective directions "C" and "D") away from the interior surface of the housing lower portion 301. Further, to avoid liquid ink becoming entrapped in the upper portion of the bladder 320 (i.e., near the fold area 327) as the bladder collapses (indicated by collapsing walls 322A' and 322B'), fluid passageways (liquid ink channels) can be formed in the wall members 322A and 322B. FIG. 8 is an end sectional view depicting wall member 322B of bladder 320 of FIG. 7. As depicted in FIG. 8, fluid passageways 328 are formed in the inner surface 323 of the wall member 322B. Thus, as can bee seen by viewing FIG. 7, as the wall members 322A and 322B come together and come in contact with one another, fluid channels 228 (FIG. 8) will allow ink to continue to flow from the bladder 320 into the standpipe 307. Ink passageways 328 of FIG. 8 can be easily formed when the wall member element 322 is an extruded member.

Figure 9:
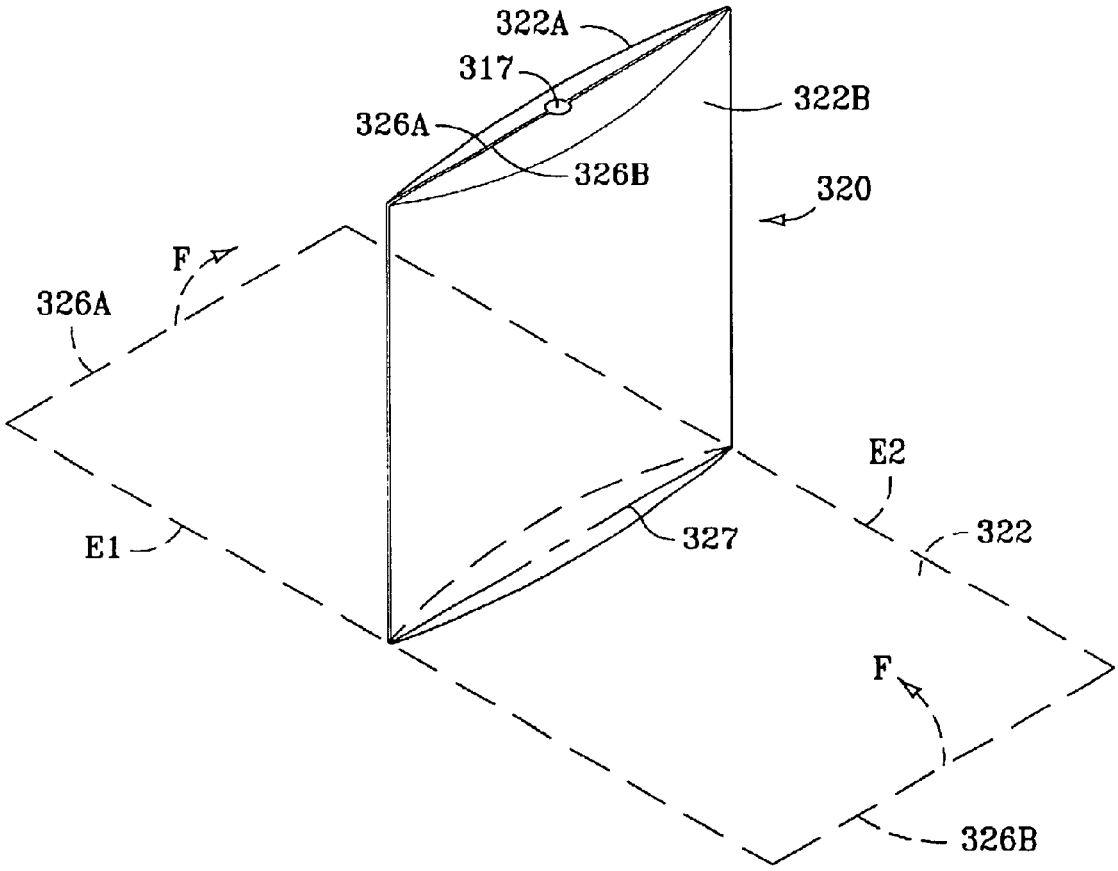
FIG. 9 is an isometric view depicting how the bladder used in the ink cartridge of FIG. 7 can be formed from a single synthetic sheet of material.

FIG. 9 is an isometric view depicting how the bladder 320 used in the ink cartridge 300 of FIG. 7 can be formed from a single synthetic sheet of material 322. The sheet of material 322 has shape-memory characteristics, as described above, so that can be elastically deformed. The sheet of material 322 is folded in directions "F" along fold-line 327 so that the ends of the sheet 326A and 326B come into contact to form the top edge of the bladder 320, thus forming the opposing first and second wall members 322A and 322B. The ends 326A and 326B are then sealed together (with heat or glue or the like). The top edges 326A and 326B can be sealed around a standpipe (such as standpipe 307 of FIG. 7) so that a standpipe opening 317 is formed along the top edge of the bladder 320. The wall members 322A and 322B are also sealed together along the respective side edges E1 and E2 of the sheet 322. The result is a pouch-shaped bladder 320, which is depicted in FIG. 9 upside-down from the orientation depicted in FIG. 7. It will thus be appreciate that a fourth embodiment includes a method of producing an expansible bladder (bladder 320, for example) for use in a liquid ink cartridge (cartridge 300, for example) according to the just-described steps. Returning to FIG. 3, it will be appreciated that the method of producing an expansible bladder (bladder system 120, for example) for use in a liquid ink cartridge (cartridge 100, for example) can further include attaching the bottom side of the expansible bladder (e.g., along fold line 327 of FIG. 9) to a fitment, such as fitment 122 (FIG. 3).

While the above embodiments have been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An ink cartridge comprising:

a housing defining a first fluid reservoir; and an expansible bladder which defines a second fluid reservoir and which is located within the first fluid reservoir, the expansible bladder comprising opposing first and second wall members, and wherein the first wall member is fabricated from a first material having a first shape-memory, and the second wall member is fabricated from a second material having a second shape memory exhibiting less shape memory than the first material, to thereby bias the first wall member to a first position relative to the second wall member.

2. The ink cartridge of claim 1, and wherein the second reservoir defined by the expansible bladder is vented to atmosphere.

3. The ink cartridge of claim 1, and wherein the first wall member comprises an extruded polyethylene member.

4. The ink cartridge of claim 3, and wherein the first wall member defines an inner surface which faces the second wall member, and further wherein the extruded polyethylene member defines an air channel formed on the inner surface.

5. The ink cartridge of claim 1, and further comprising liquid ink disposed within the first fluid reservoir.

6. The ink cartridge of claim 1, and further comprising liquid ink disposed within the second fluid reservoir.

7. The ink cartridge of claim 1, and further comprising opposing third and fourth wall members, and wherein the third wall member is fabricated from a material having the first shape-memory, and the fourth wall member is fabricated from a material having the second shape memory.

8. The ink cartridge of claim 7, and wherein the first and third wall members are formed from a first sheet defined by a first periphery, the second and fourth wall members art formed from a second sheet defined by a second periphery, and the first sheet and the second sheet are generally attached along the first and second peripheries.

9. An expansible bladder for use in a liquid ink cartridge, the expansible bladder comprising:

a synthetic sheet shaped to define opposing first and second wall members, wherein the synthetic sheet is fabricated from a material having a shape-memory to thereby bias the first and second wall members to a first position relative to one another; and wherein the synthetic sheet is defined by a primary surface, and wherein the synthetic sheet further comprises an air channel segment which protrudes above the primary surface.

10. The expansible bladder of claim 9, and wherein the synthetic sheet is a polyethylene extrusion.

11. The expansible bladder of claim 9, and wherein when the first and second wall members are each in the first position, the wall members are concave in shape relative to one another.

12. The expansible bladder of claim 9, and wherein when the first and second wall members are each in the first position, the wall members are convex in shape relative to one another.

13. The expansible bladder of claim 9, and wherein the synthetic sheet is defined by a thickness, and the thickness is between about 5 mils and about 15 mils.

14. The expansible bladder of claim 13, and wherein the thickness is between about 7 mils and 10 mils.

15. The expansible bladder of claim 9, and wherein the air channel segment is characterized by an irregular outward facing surface with respect to the primary surface.

16. The expansible bladder of claim 9, and wherein the synthetic sheet is a first synthetic sheet defined by a first periphery, the expansible bladder further comprising a second synthetic sheet defined by a second periphery, and further wherein:

the first synthetic sheet and the second synthetic sheet are attached along the first and second peripheries;

the first synthetic sheet is defined by a first thickness, and the first thickness is between about 5 mils and about 15 mils; and the second synthetic sheet is defined by a second thickness, and the second thickness is between about 1 mil and about 3 mils.

17. A method of producing an expansible bladder for use in a liquid ink cartridge, comprising:

providing a synthetic sheet fabricated from a material having a shape-memory;

folding the sheet in a generally "U" shape so as to produce first and second opposing wall members and thereby bias the first and second opposing wall members to a first position relative to one another, each wall member being defined by two side edges and a top edge;

sealing the first wall member to the second wall member along the side edges and top edges of the wall members to thereby produce the expansible bladder; and wherein the synthetic sheet further defines a primary surface, and an air channel segment which protrudes above the primary surface.

18. The method of claim 17, and wherein the synthetic sheet is essentially flat prior to being folded.

19. The method of claim 17, and wherein the expansible bladder is defined by a bottom side which is opposite the top edges of the wall members, the method further comprising attaching the bottom side of the expansible bladder to a fitment.

20. An expansible bladder for use in a liquid ink cartridge, the expansible bladder comprising:

a first synthetic sheet defining first and third wall members, the first synthetic sheet defined by a first periphery and being fabricated from a first material having a first shape-memory;

a second synthetic sheet defining second and fourth wall members, the second synthetic sheet defined by a second periphery and being fabricated from a second material having a second shape-memory exhibiting less shape memory than the first shape-memory; and wherein the first synthetic sheet and the second synthetic sheet are generally joined along the first and second peripheries.

21. The expansible bladder of claim 20, and wherein the first synthetic sheet comprises an extruded polyethylene sheet having a thickness of between about 5 mils and 15 mils.

22. The expansible bladder of claim 21, and wherein the first synthetic sheet comprises an extruded polyethylene sheet having a thickness of between about 1 mil and 2 mils.

23. The expansible bladder of claim 20, and further comprising a fitment which directly supports the first synthetic sheet and the second synthetic sheet.

24. The expansible bladder of claim 23, and wherein the first synthetic sheet is supported by the fitment to place the first and third wall members in generally opposing orientation.

* * * * *

UNITED STATES PATENT AND TRADEMARK OFFICE

CERTIFICATE OF CORRECTION

PATENT NO. : 6,883,907 B2
APPLICATION NO. : 10/279644
DATED : April 26, 2005
INVENTOR(S) : Adrian J. Martinez It is certified that error appears in the above-identified patent and that said Letters Patent is hereby corrected as shown below:

Column 3, Line 21, delete "inn" and insert therefor --in--

Column 6, Line 66, delete second occurrence of "in the"

Column 10, Line 11, delete "bee" and insert therefor --be--

Column 10, Line 34, delete "appreciate" and insert therefor --appreciated--

Column 11, Line 21, delete "art" and insert therefor --are--

Claim 20, Column 12, Line 44, delete "peripheries." and insert the following
-- peripheries; and
wherein first synthetic sheet and the second synthetic sheet further include a top edge wherein the top edge includes an air channel segment affixed to the top edge and protruding above the top edge. --

Signed and Sealed this

Eighth Day of September, 2009

David J. Kappos

David J. Kappos
*Director of the United States Patent and Trademark Office*